US006315165B1

(12) United States Patent
Regan

(10) Patent No.: US 6,315,165 B1
(45) Date of Patent: Nov. 13, 2001

(54) DEVICE FOR EXPRESSING SUBSTANCES FROM A DEFORMABLE TUBE

(75) Inventor: Philip M. Regan, Drunen (NL)

(73) Assignee: Loctite (R&D) Limited, Dublin (IE)

( * ) Notice: Subject to any disclaimer, the term of this patent is extended or adjusted under 35 U.S.C. 154(b) by 0 days.

(21) Appl. No.: 09/673,331

(22) PCT Filed: Jun. 29, 1999

(86) PCT No.: PCT/IE99/00059

§ 371 Date: Oct. 13, 2000

§ 102(e) Date: Oct. 13, 2000

(87) PCT Pub. No.: WO00/00405

PCT Pub. Date: Jan. 6, 2000

(30) Foreign Application Priority Data

Jun. 30, 1998 (IR) ..... 980530

(51) Int. Cl.[7] ..... B65D 25/28
(52) U.S. Cl. ..... 222/103
(58) Field of Search ..... 222/82, 94, 103, 222/214, 215

(56) References Cited

U.S. PATENT DOCUMENTS

| | | | | |
|---|---|---|---|---|
| 1,876,489 | | 9/1932 | Collins . | |
| 2,092,924 | * | 9/1937 | Lewis | 222/94 |
| 2,291,282 | * | 7/1942 | Hollenbeck | 222/94 |
| 2,542,350 | | 2/1951 | Paulsen | 222/499 |
| 2,568,286 | | 9/1951 | Littlefield | 222/103 |
| 2,589,058 | | 3/1952 | Corson et al. | 222/93 |
| 2,613,853 | | 10/1952 | Halvorsen | 222/103 |
| 3,125,250 | | 3/1964 | Ballin | 222/96 |
| 3,211,341 | | 10/1965 | Bailey | 222/103 |
| 3,405,843 | | 10/1968 | Watson, Jr. | 222/95 |
| 3,884,379 | | 5/1975 | Landen | 215/221 |
| 3,892,326 | | 7/1975 | Schneible | 215/221 |
| 3,902,620 | | 9/1975 | McIntosh | 215/209 |
| 3,939,788 | | 2/1976 | Schneible | 113/121 A |

(List continued on next page.)

FOREIGN PATENT DOCUMENTS

| | | | | |
|---|---|---|---|---|
| 418523 | | 12/1936 | (BE) . | |
| 0 504 213 | * | 9/1992 | (EP) | B43M/11/06 |
| 0 521 200 | * | 1/1993 | (EP) | B65D/35/28 |
| 0 304 972 | | 3/1989 | (EP) | B65D/47/36 |
| 0 579 906 | * | 1/1994 | (EP) | B65D/83/00 |
| 1 170 939 | | 1/1959 | (FR) . | |
| 1 210 659 | | 3/1960 | (FR) . | |
| 451933 | | 8/1936 | (GB) | 960/35 |
| 2 206 567 | | 1/1989 | (GB) | B65D/51/20 |
| WO 91/08116 | | 6/1991 | (WO) | B43M/11/06 |
| WO 99/44904 | * | 9/1999 | (WO) | B65D/35/14 |
| WO 99/44907 | * | 9/1999 | (WO) | B65D/51/22 |

* cited by examiner

*Primary Examiner*—Philippe Derakshani
*Assistant Examiner*—Thach H. Bui
(74) *Attorney, Agent, or Firm*—Steven C. Bauman

(57) ABSTRACT

The device has a casing (1) having a base end (2), a top portion (3) opposite the base end and side wall portions (4) intermediate the base end and the top portion; a squeezer (11) insertable in the casing (1); the squeezer comprising two opposing jaws (12, 13) for gripping and expressing a substance from the tube (24). The casing (1) has an aperture (5) in the top portion (3) through which a discharge outlet (26) of a tube (24) is extendable and further having apertures (8) in opposing parts of the side wall portions through which the jaws (12, 13) are actuatable. The casing (1) is open at its base end and the squeezer (11) is insertable into the casing through its open base end. The jaws of the squeezer are attached at one end to a carrier (14) and the carrier and the casing have interengaging formations for retention of the squeezer in the casing. The squeezer (11) and the carrier (14) are integrally formed so as to form a unitary body. The device allows ease of expression of the substance from the tube (24).

20 Claims, 5 Drawing Sheets

U.S. PATENT DOCUMENTS

| | | | | |
|---|---|---|---|---|
| 3,986,626 | | 10/1976 | Montgomery | 215/216 |
| 4,106,651 | | 8/1978 | Lemons | 215/221 |
| 4,141,476 | | 2/1979 | Rech | 222/505 |
| 4,154,353 | | 5/1979 | Hoo | 215/209 |
| 4,211,348 | | 7/1980 | Scholle | 222/498 |
| 4,213,543 | | 7/1980 | Thiem | 222/103 |
| 4,271,982 | | 6/1981 | Niksich et al. | 222/83 |
| 4,334,638 | | 6/1982 | Stock | 222/153 |
| 4,345,691 | | 8/1982 | Burke | 215/216 |
| 4,376,495 | | 3/1983 | Spatz | 222/46 |
| 4,394,944 | * | 7/1983 | Rech | 222/553 |
| 4,470,521 | * | 9/1984 | Scammell | 222/107 |
| 4,500,016 | * | 2/1985 | Funfstuck | 222/153 |
| 4,651,901 | * | 3/1987 | Ozdemir | 222/153 |
| 4,718,567 | * | 1/1988 | La Vange | 215/216 |
| 4,723,687 | * | 2/1988 | Kurterer et al. | 222/83 |
| 4,865,209 | * | 9/1989 | Bush | 215/216 |
| 4,884,705 | * | 12/1989 | Debetencourt | 215/250 |
| 4,941,598 | * | 7/1990 | Lambelet, Jr. et al. | 222/321 |
| 4,946,075 | * | 8/1990 | Lundback | 222/181 |
| 5,082,129 | * | 1/1992 | Kramer | 215/221 |
| 5,096,077 | * | 3/1992 | Odet et al. | 215/211 |
| 5,137,178 | * | 8/1992 | Stokes et al. | 222/94 |
| 5,145,080 | * | 9/1992 | Imbery, Jr. | 215/331 |
| 5,147,053 | * | 9/1992 | Friedenthal | 215/216 |
| 5,246,145 | * | 9/1993 | Leoncavallo et al. | 222/153 |
| 5,377,870 | * | 1/1995 | Morel | 222/23 |
| 5,501,370 | * | 3/1996 | Okamura et al. | 222/111 |
| 5,505,342 | * | 4/1996 | Okamura et al. | 222/212 |
| 5,517,180 | * | 5/1996 | Masi et al. | 222/613 |
| 5,560,505 | * | 10/1996 | Schneider et al. | 215/330 |
| 5,649,646 | | 7/1997 | Foster et al. | 222/153.14 |
| 5,687,863 | | 11/1997 | Kusz | 215/216 |
| 5,749,496 | | 5/1998 | DeJonge, Sr. et al. | 222/153.14 |
| 5,871,128 | | 2/1999 | Carroll | 222/568 |
| 5,970,588 | | 10/1999 | Hurtz et al. | 24/657 |

DEVICE FOR EXPRESSING SUBSTANCES FROM A DEFORMABLE TUBE

FIELD OF THE INVENTION

The present invention relates to a device for expressing a substance from a deformable tube. The tubes in question are yieldable tubes which are usually comprised of metal or plastics. The metal or plastics tubes are squeezable. Squeezing of the tube by hand expresses the substance contained in the tube through a delivery nozzle. This can be a tricky and messy operation especially when the tube is not completely full. The amount of substance being expressed is not easy to regulate by pressing with fingers, and it is difficult to simultaneously regulate the amount dispensed and its application to a substrate. Accordingly dispensing devices have been used to overcome these problems. Examples of deformable tubes include those containing pasty or thixotropic substances such as adhesive.

BACKGROUND OF THE INVENTION

Many dispensing devices are known for example from UK patent application No. 2,206,567 A and UK patent No. 451,933, French patent application Nos. 1,170,939, 1,210,659 and 1,170,939, U.S. Pat. Nos. 1,876,489, 4,213,543, 3,405,843, 2,568,286, 2,589,058, 2,613,853, 4,334,638 and 4,723,687, Belgian patent application No. 418523. Such devices provide various methods of expressing a substance from a tube.

A further device of the type described above is disclosed in European patent publication No. 0,521,200. This European publication describes a device having a casing having a base end, a top portion opposite the base end and side wall portions intermediate the base end and the top portion, a squeezer insertable in the casing, the squeezer comprising two opposing jaws for gripping and expressing a substance from the tube, the casing having an aperture in the top portion through which a discharge outlet of the tube is extendable and further having apertures in opposing parts of the side wall portions through which the jaws are actuatable. This document forms the preamble to claim 1.

The device disclosed in EP 0,521,200 has a two-part casing which comprises two shell halves pivotally connected together. The squeezer is a separate piece which must be positioned correctly in cradles provided on the casing. The tube is inserted by opening the shell halves, correctly positioning the tube within the jaws of the squeezer and correctly positioning the hinged end of the squeezer in the cradles. Accordingly it is desired to provide an alternative mode of insertion of the tube. Furthermore it is desired to provide a construction of device which is mechanically simpler than that disclosed in EP 0,521,200.

EP 0,504,213 describes an adhesive dispenser for dispensing adhesive from a deformable tube. The dispenser is provided with a child-proof locking cap which may be locked to the barrel by a collar. The collar is slidable axially, with respect to the barrel, between an operative locking position where the collar engages both the cap and the barrel, preventing relative rotation of the cap and barrel, so that the cap can not be unscrewed from the barrel, and an inoperative position spaced from the cap in which the cap can be removed.

The cap of the device is provided with latching arms which are arranged to engage in corresponding clips on the barrel body.

The dispenser is provided with a mechanism for piercing a sealing membrane in the dispensing nozzle of the deformable tube. The cap has a pin aligned with the outlet passage in the nozzle when the cap is placed on the barrel. When the cap is fully screwed down the pin extends just past a sealing membrane in the tube rupturing the membrane if still intact.

U.S. Pat. No. 5,505,342 discloses a composite container for low viscosity liquids. One embodiment describes a "lachet teeth" arrangement provided between the cap of the container and the container body, the lachet teeth arrangement preventing over-tightening of the cap on the composite container by providing a torque-slip arrangement whereby once a desired level of torque is reached while screwing the cap on, additional torque causes the cap to slip, remaining at the same position and not becoming tighter.

A second "lachet teeth" arrangement between the nozzle of the container and the container body allows screwing of the nozzle onto the container by a screw thread arrangement. However the nozzle once screwed on cannot be unscrewed by rotation in an opposing direction as the arrangement causes engagement of the nozzle with the container preventing relative rotation.

OBJECT OF THE INVENTION

It is an object of the present invention to provide an alternative device which is of more simple construction than that of EP 0,521,200 and which allows ease of insertion of the deformable tube.

SUMMARY OF THE INVENTION

The present invention provides a device for expressing a substance from a deformable tube, the device comprising:

a casing having a base end, a top portion opposite the base end and side wall portions intermediate the base end and the top portion, a squeezer insertable in the casing, the squeezer comprising two opposing jaws for gripping and expressing a substance from the tube, the casing having an aperture in the top portion through which a discharge outlet of the tube is extendable and further having apertures in opposing parts of the side wall portions through which the jaws are actuatable, characterised in that the casing is open at its base end, the squeezer is insertable into the casing through its open base end, the jaws of the squeezer are attached at one end to a carrier, and the carrier and the casing have interengaging formations for retention of the squeezer in the casing.

This formation provides a very simple construction which is economical to manufacture and extremely simple to assemble. The casing can be made in one piece. It allows for ease of insertion of the deformable tube into the device through the open base end, followed by insertion of the squeezer so that the jaws embrace the deformable tube.

Suitably the squeezer and the carrier are integrally formed so as to form a unitary body. In this case the squeezer and carrier may be moulded in one piece. Desirably, each jaw of the squeezer is attached at one end to the carrier by a resiliently deformable member. This construction biases the jaws toward their open position and provides a hinge-like action, for the jaws.

In one embodiment of the invention the carrier forms a base for the casing on insertion of the squeezer in the casing. In this arrangement the construction of the device is simple and allows for ease of manufacture.

In one arrangement the interengaging formations comprise a snap-fit rim and corresponding peripheral recess. In a desired construction the casing has a central body portion which is part-cylindrical in shape and the casing extends outwardly in its lower region to form two shoulder portions. This construction allows for ease of insertion of the squeezer in the casing.

Suitably the device further comprises a dispensing nozzle attachable by a screw-threaded arrangement to the discharge outlet of the tube, the dispensing nozzle and the casing having interengaging rachet formations to lock the nozzle and the casing against relative rotation. The invention extends to a device for expressing a substance from a deformable tube substantially as described herein with reference to and as illustrated in the accompanying drawings.

DETAILED DESCRIPTION OF THE DRAWINGS

One embodiment of the device of the invention will be described in more detail with reference to FIGS. 1 to 6.

Figure 1:
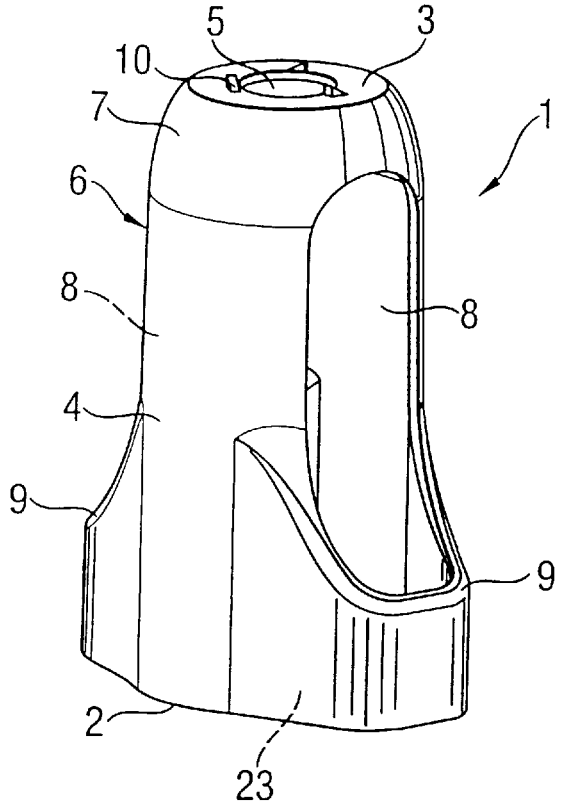
FIG. 1 shows a perspective view of a casing for the device of the invention.

FIG. 1 shows a hollow casing 1 having an open base end 2, a top portion 3 opposite the base end 2 and side wall portions 4 intermediate the base end and the top portion. The top portion 3 has an aperture 5 through which the discharge outlet 26 of a deformable tube 24 (see FIG. 3) is extendable. The casing 1 forms a sleeve-like or socket/receptor-type arrangement. The casing 1 has a central body portion 6 which is part cylindrical in shape and which extends from the base end 2 to the top portion 3 tapering inwardly close to the top portion 3 to provide a rounded head 7. Two slot-type apertures 8 are provided in opposing parts of the side wall portions 4. In its lower region, the casing is extended outwardly to form two shoulder portions 9 each respectively on opposing parts of the side wall portions 4 and part defining the apertures 8. The open base end 2 is defined by the central body portion 6, and the two shoulder portions 9 which are angular, so that the central portion 6 and each shoulder portion 9 define a key-hole type aperture so that the open end 2 has a double key-hole type shape. Rachet members 10 are provided on the periphery of the aperture 5 for engaging a dispensing nozzle described below, see for example FIG. 3.

Figure 2:
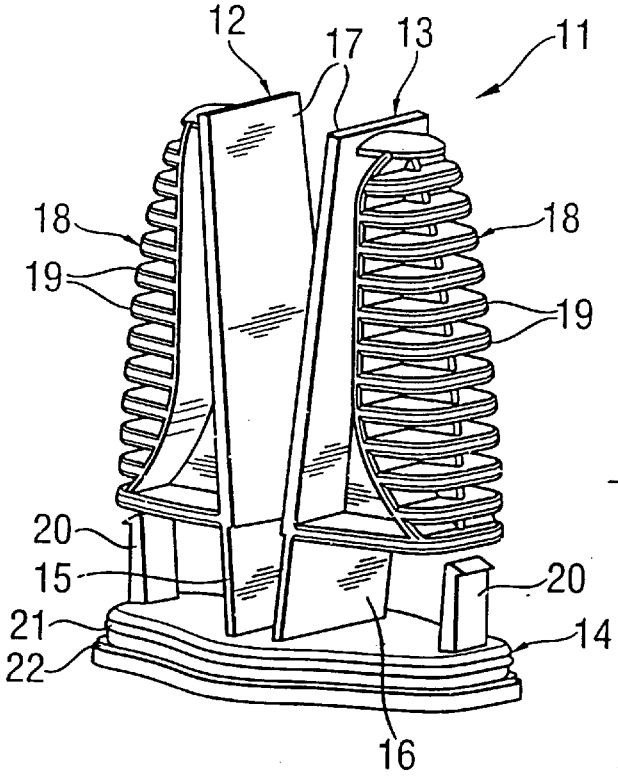
FIG. 2 is a perspective view of a squeezer and carrier which is insertable in the casing of FIG. 1.

FIG. 2 shows a squeezer 11 which is insertable in the casing 1. The squeezer has two opposing jaws 12,13 which have a closed end and an open end and which are held away from each other at the open end but are actuatable towards each other for gripping and expressing a substance from a deformable tube placed between the respective jaws 12,13. Each jaw 12,13 is attached at the closed end to a carrier 14 by a resiliently deformable member formed by legs 15,16 respectively. The jaws 12,13 and the carrier 14 may be formed as a unitary body and thus moulded as a single piece. The legs 15,16 are arranged on the carrier 14 so that the jaws 12,13 diverge from the carrier s to the free end of the jaws 12,13, forming a general V-shape arrangement. The V-shape arrangement is particularly suited for receiving a deformable tube. Each jaw 12,13 has a flat gripping or pressing surface 17 for pressing on the sides a deformable tube along the length of the sides of the tube. Each flat surface member 17 has fitted thereto a curved member 18 which forms a finger grip for actuating the jaws 12,13. The curved member 18 is formed by a series of ribs 19 which act as grips. The carrier 14 is a plate which has a profile corresponding in shape to the open end of the casing 1. The carrier 14 has two upstanding snap-fit members 20 which snap-fit with interengaging formations on the inner surface of the casing 1 when the squeezer 11 is inserted in the casing 1. The carrier 14 has a stepped surface formed by an upper rim 21 and a lower rim 22, the lower rim 22 projecting beyond the upper rim 21 about the perimeter of the carrier 14. The upper rim 21 forms a snap-fit rim which snap-fits into an annular recess on the underside of the casing.

In the operating configuration of the device the squeezer 11 is inserted into the open base end 2 of the casing 1. The jaws 12,13 pass inside the shoulder portions 9 and are then exposed through the slot-type apertures 8. The curved gripping member 18 complete a smooth profile from the top portion 3 to the shoulder portions 9 (see FIGS. 4 and 6). The casing 1 acts as a socket-type arrangement so that when the squeezer 2 is inserted the upper rim 21 fits snugly into the aperture 23 (and engages therein) while the periphery of the base end 2 abuts the lower rim 22. The assembled device will be described in more detail hereafter.

Figure 3:
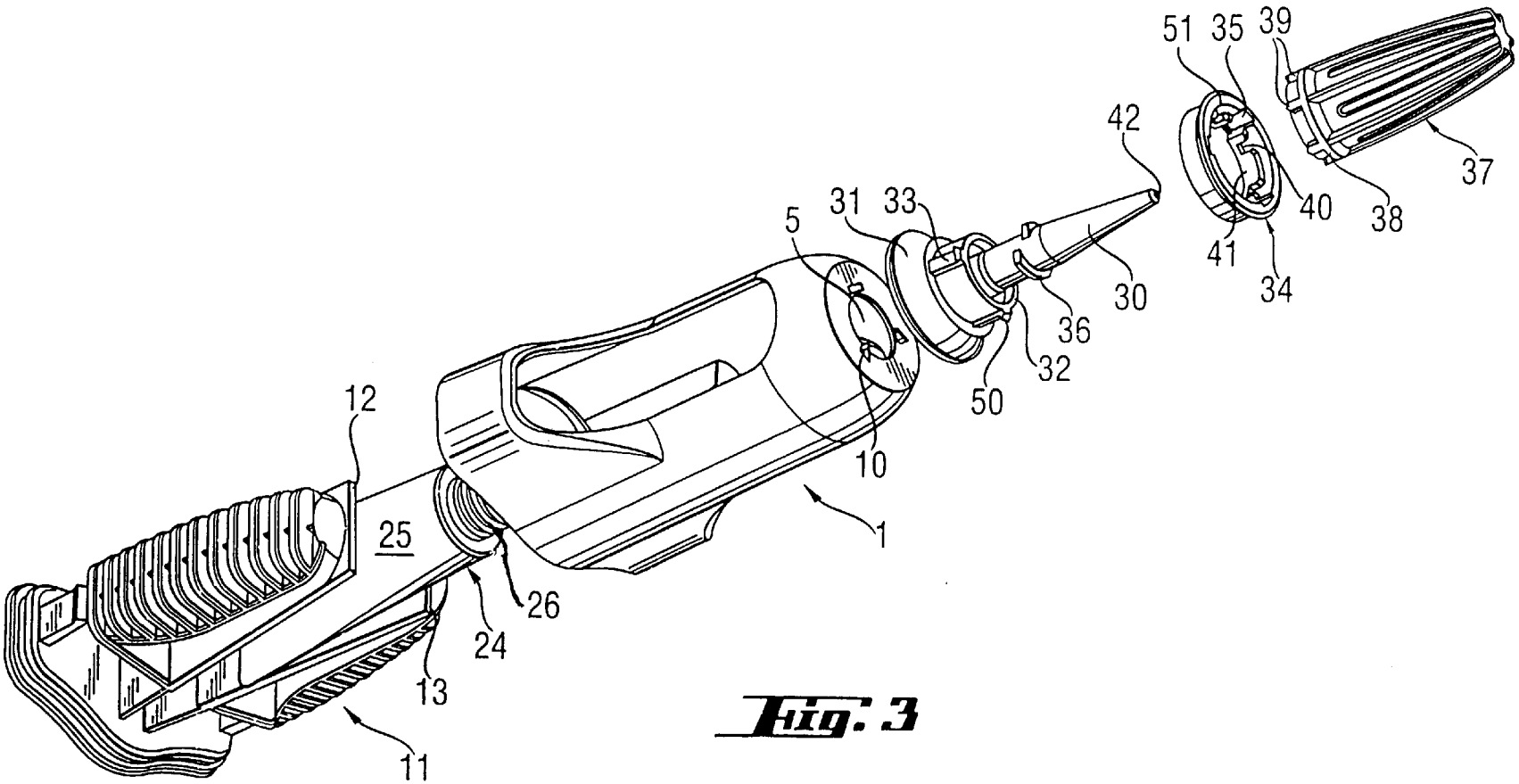
FIG. 3 shows an exploded view of the device of the invention together with a dispensing nozzle, a collar and a cap.

FIG. 3 shows an exploded view of the device as it would be assembled for use. The assembled device can be seen in cross-section in FIG. 4. A deformable tube 24, containing adhesive, is placed between the jaws 12,13 of the squeezer 11. The deformable tube has a body 25 and fits snugly in the V-shaped cradle formed by the jaws 12,13. The adhesive tube has a discharge outlet 26 which is screw-threaded. In the assembled configuration the discharge outlet 26 extends through aperture 5 in the casing 1. A dispensing nozzle 30 with reciprocal screw-threads 53 on its underside in particular on the underside of the skirt 31 is adapted to screw onto the screw-threads 52 of nozzle 26 in the operational configuration where nozzle 26 extends through aperture 5. The screw-threads 52 of the nozzle 26 engaged in reciprocal screw-threads 53 on the underside of dispensing nozzle 30 can be seen in FIG. 4. Also provided on the underside of the skirt 31 are a series of projections which engage with rachet members 10 on the top portion of the casing 1. The interengagement of these two sets of formations creates a locking mechanism which locks the dispensing nozzle 30 against rotation in the direction of unscrewing the nozzle 30 from the screw-threads of nozzle 26 (the anticlockwise direction as shown in FIG. 3).

Above the skirt 31 is located a ring-shaped retaining member 32. The retaining member 32 has three engaging projections 33 axially aligned and evenly spaced about the outer perimeter of the retaining member 32. A separate collar 34 (see FIG. 5) has three internal corresponding recesses 35 which form interengaging formations with the engaging projections 33 of the dispensing nozzle 30. The collar 34 thus is a snap-fit over the retaining member 32. When snap-fit engagement of the collar 34 and the retaining member 32 has taken place the collar 34 is still axially slidable on the retaining member 32. The engaging projections 33 each have a stop 50 at its upper end to prevent the collar 32 being removed from the dispensing nozzle 30. The stops 50 slide in recesses 35. Movement of the stops 50 out of recesses 35 is prevented by rim 51 of the collar 34.

The dispensing nozzle 30 is provided with a screw-thread member 36 in the form of a helical ridge for interengagement with internal screw-threads on a protective cap 37. The lower outer rim 38 of the cap 37 has a number of projections 39 which are engagable with corresponding recesses 40 located on an internal annular rim 41 of the collar 34.

When the protective cap 37 is screwed onto the screw-thread member 36 it protects the opening 42 on the dispensing nozzle 30. In this position the collar 34 is movable between two positions, one position proximate the skirt 31 in which the protective cap 37 may be removed, and a second position axially spaced from the skirt 31 towards the protective cap 37 in which the collar 34 engages the protective cap 37 by engagement of the projections 39 on cap 37 in the recesses 40 on the internal annular rim 41 of the collar 34. In this way the cap may be locked against rotation and thus removal.

Figure 4:
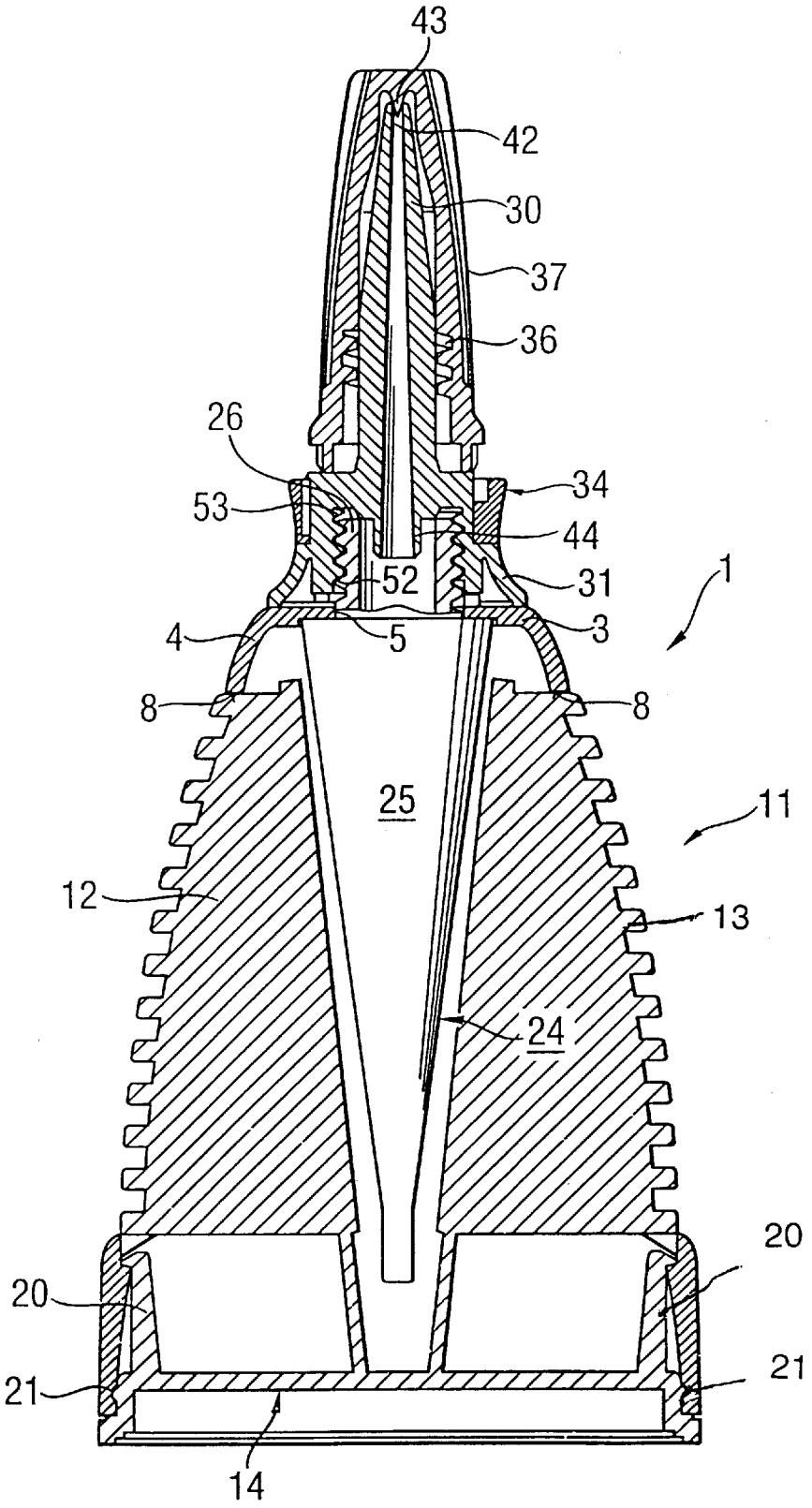
FIG. 4 shows a sectional view of the assembled device shown in exploded view in FIG. 3.

The assembled device can be seen in cross-section in FIG. 4. The cap 37 has been screw-threadingly engaged on screw-thread member 36 and is in the fully closed position. In this position a protective tip 43 extends into the opening 42 on the dispensing nozzle 30.

A piercing tip 44 is provided on the underside of the dispensing nozzle 30 for rupturing a membrane formed across the mouth of the tube 24. In this way a sealed tube is automatically ruptured open on insertion of the tube 24 into the device of the invention and rotation of the tube so that the screw threads of the tube engage the screw threads of the dispensing nozzle. The device of the invention can be assembled/packaged for sale with the dispensing nozzle 30 only partially screwed onto the tube 24 so that the membrane in the tube is left intact. The end user completes the screwing down of the nozzle 30, when it is desired to use the device, thus rupturing the membrane for use. This movement locks the nozzle 30 in place as described above, so that the nozzle 30 is no longer removable. The tube of adhesive cannot be removed even if the carrier/squeezer arrangement is removed from the casing as the tube is held in position by the nozzle 30 which in turn is locked in place. In the position shown in FIG. 4 the collar 34 is in the unlocked position proximate the skirt 31 on the dispensing nozzle 30. The jaws 12,13 extend through apertures 8 and the carrier 14 is snap-fit engaged in the casing 1. The upper rim 21 forms a "snap-ring" which is snap-fitted in a corresponding annular recess on the underside of the casing 1. The upstanding snap-fit members 20 also each engage on a corresponding recess in the underside of the shoulder portions 9 of the casing 1.

Figure 5:
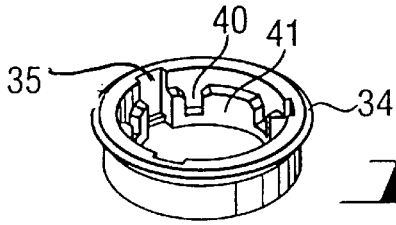
FIG. 5 shows a collar suitable for use with the dispensing nozzle which forms part of the device of the present invention.

A perspective view of the collar 34 is shown in FIG. 5.

Figure 6:
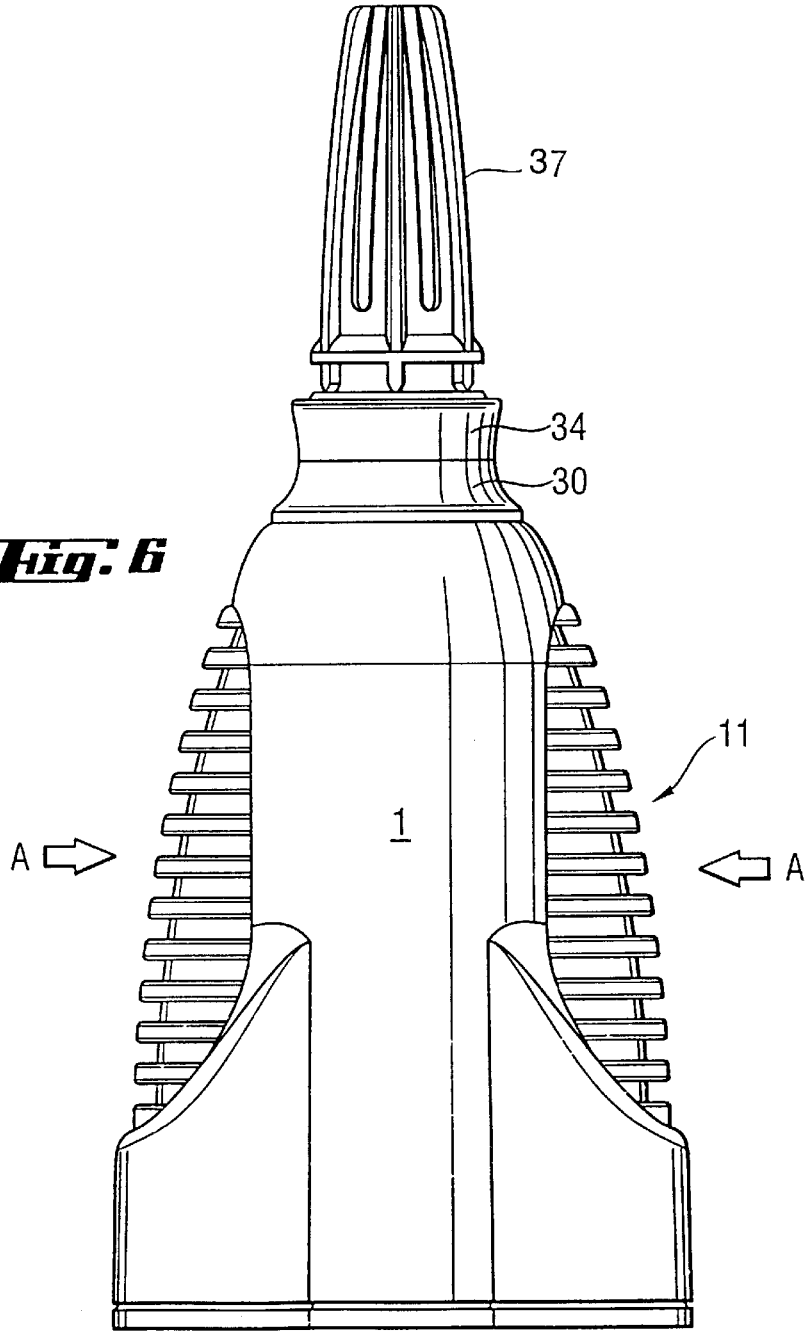
FIG. 6 shows an elevation of the fully assembled device.

An elevation of the assembled device of the invention is shown in FIG. 6. The tube 24 is retained therein. In order to dispense adhesive from the tube 24 the protective cap 27 is removed and the jaws 27 are pressed inwardly in the direction of the arrows A.

Figure 7:
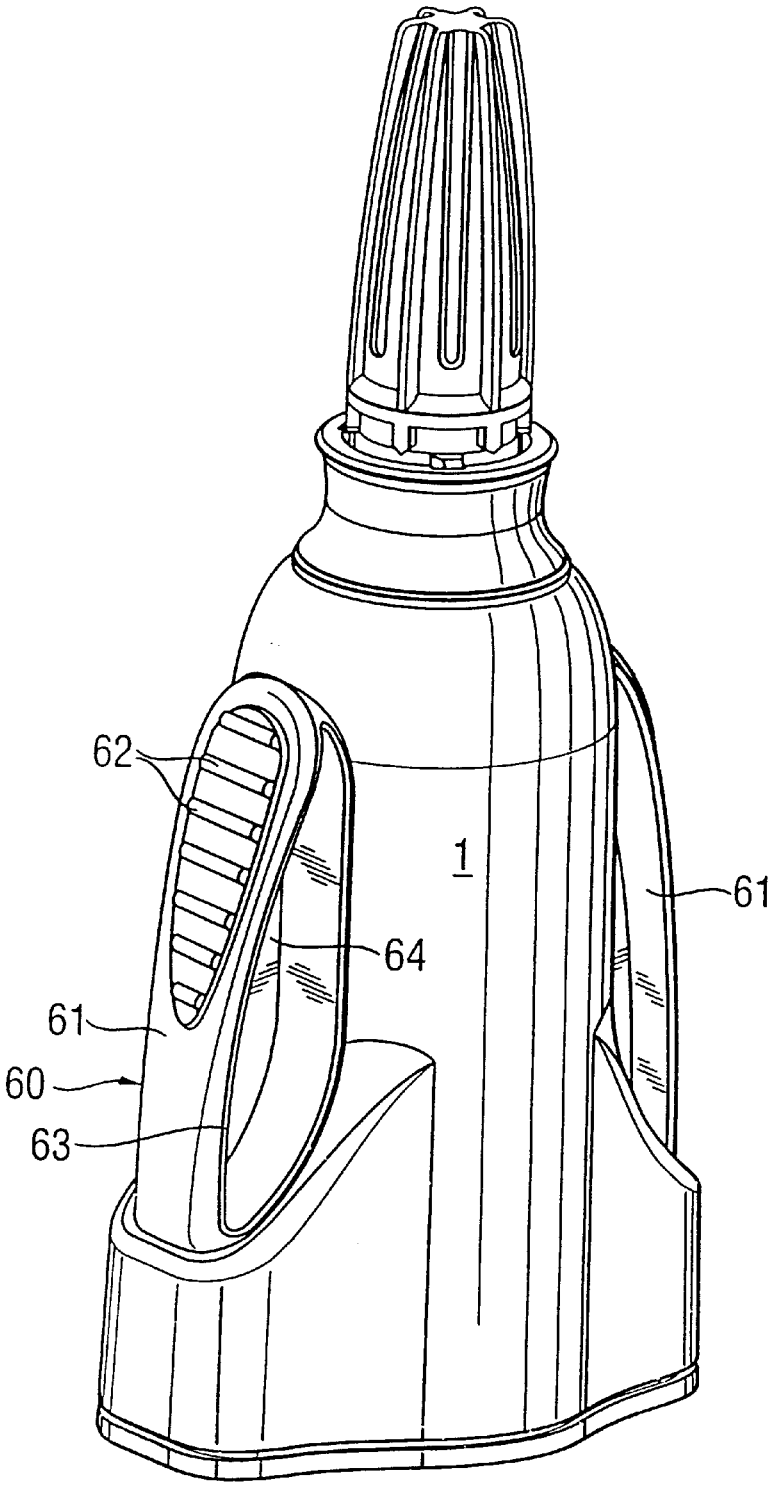
FIG. 7 is a perspective view of a second embodiment of the device of the invention shown in the fully assembled condition, and having an alternative finger grip arrangement on the squeezer.

A second embodiment with a squeezer 60 having an alternative finger grip arrangement is shown in FIG. 7. The squeezer is identical to the squeezer 11 described above except for the finger grip arrangement which is provided by curved members 61 having a series of gripping ribs 62 provided on its outer surface to allow ease of gripping the gripping portion 60 in the hand. The curved member 61 forms part of a curved plate 63 which matches the profile of the casing 1 and which stands proud on both sides of a central spine 64. Other arrangements of squeezer are also possible.

What is claimed is:

1. A device for expressing a substance from a deformable tube, the device comprising:

(a) a casing having a base end, a top portion opposite the base end and side wall portions intermediate the base end and the top portion, (b) a squeezer insertable in the casing; the squeezer comprising two opposing jaws for gripping and expressing a substance from the tube, (c) the casing having an aperture in the top portion through which a discharge outlet of the tube is extendable and further having apertures in opposing parts of the side wall portions through which the jaws are actuatable, wherein the casing is open at its base end, the squeezer is insertable into the casing through its open base end, the jaws of the squeezer are attached at one end to a carrier, and the carrier and the casing have interengaging formations for retention of the squeezer in the casing.

2. A device according to claim 1, wherein the squeezer and the carrier are integrally formed so as to form a unitary body.

3. A device according to claim 1, wherein each jaw is attached to the carrier at one end by a resiliently deformable member.

4. A device according to claim 1, wherein the carrier forms a base for the casing on insertion of the squeezer in the casing.

5. A device according to claim 1, wherein the interengaging formations comprise a snap-fit rim and a corresponding peripheral recess.

6. A device according to claim 1, wherein the casing has a central body portion which is part-cylindrical in shape and the casing extends outwardly in its lower region to form two shoulder portions.

7. A device according to claim 1, wherein the device further comprises a dispensing nozzle for the discharge outlet of the tube, the dispensing nozzle and the casing having interengaging rachet formations to lock the nozzle and the casing against relative rotation.

8. A device according to claim 2, wherein each jaw is attached to the carrier at one end by a resiliently deformable member.

9. A device according to claim 2, wherein the carrier forms a base for the casing on insertion of the squeezer in the casing.

10. A device according to claim 3, wherein the carrier forms a base for the casing on insertion of the squeezer in the casing.

11. A device according to claim 4, wherein the interengaging formations comprise a snap-fit rim and a corresponding peripheral recess.

12. A device according to claim 2, wherein the casing has a central body portion which is part-cylindrical in shape and the casing extends outwardly in its lower region to form two shoulder portions.

13. A device according to claim 3, wherein the casing has a central body portion which is part-cylindrical in shape and the casing extends outwardly in its lower region to form two shoulder portions.

14. A device according to claim 4, wherein the casing has a central body portion which is part-cylindrical in shape and the casing extends outwardly in its lower region to form two shoulder portions.

15. A device according to claim 5, wherein the casing has a central body portion which is part-cylindrical in shape and the casing extends outwardly in its lower region to form two shoulder portions.

16. A device according to claim 2, wherein the device further comprises a dispensing nozzle for the discharge outlet of the tube, the dispensing nozzle and the casing having interengaging rachet formations to lock the nozzle and the casing against relative rotation.

17. A device according to claim 3, wherein the device further comprises a dispensing nozzle for the discharge outlet of the tube, the dispensing nozzle and the casing having interengaging rachet formations to lock the nozzle and the casing against relative rotation.

18. A device according to claim 4, wherein the device further comprises a dispensing nozzle for the discharge outlet of the tube, the dispensing nozzle and the casing having interengaging rachet formations to lock the nozzle and the casing against relative rotation.

19. A device according to claim 5, wherein the device further comprises a dispensing nozzle for the discharge outlet of the tube, the dispensing nozzle and the casing having interengaging rachet formations to lock the nozzle and the casing against relative rotation.

20. A device according to claim 6, wherein the device further comprises a dispensing nozzle for the discharge outlet of the tube, the dispensing nozzle and the casing having interengaging rachet formations to lock the nozzle and the casing against relative rotation.

* * * * *

UNITED STATES PATENT AND TRADEMARK OFFICE

CERTIFICATE OF CORRECTION

PATENT NO. : 6,315,165 B1
DATED : November 13, 2001
INVENTOR(S) : Philip Regan

It is certified that error appears in the above-identified patent and that said Letters Patent is hereby corrected as shown below:

Column 4,
Line 5, before "to" delete -- s --

Signed and Sealed this

Twenty-third Day of July, 2002

*Attest:*

*Attesting Officer*

JAMES E. ROGAN
*Director of the United States Patent and Trademark Office*